United States Patent [19]

Kilgrow et al.

[11] Patent Number: 4,995,756

[45] Date of Patent: Feb. 26, 1991

[54] VEHICLE TIRE DEFLATOR

[76] Inventors: Donald C. Kilgrow; Linda Kilgrow, both of P.O. Box 844, Monticello, Utah 84535; Melvin H. Pedersen, 845 Park St., Salt Lake City, Utah 84102

[21] Appl. No.: 471,608

[22] Filed: Jan. 29, 1990

[51] Int. Cl.[5] ..... E01F 13/00

[52] U.S. Cl. ..... 404/6; 256/1

[58] Field of Search ..... 404/6, 9; 256/1

[56] References Cited

U.S. PATENT DOCUMENTS

| | | | |
|---|---|---|---|
| 1,276,100 | 8/1918 | Niznik | 256/1 |
| 2,912,229 | 11/1959 | Persgard | 256/1 |
| 3,652,059 | 3/1972 | Groblebe | 256/1 |

FOREIGN PATENT DOCUMENTS

| | | |
|---|---|---|
| 593355 | 2/1934 | Fed. Rep. of Germany . |
| 2032983 | 5/1980 | United Kingdom . |

*Primary Examiner*—William P. Neuder

*Attorney, Agent, or Firm*—M. Reid Russell

[57] ABSTRACT

A vehicle tire deflator comprising a foldable and extendible frame with one or more rocker arms releasably carrying hollow spikes and having rocker arm actuators attached to the rocker arms to pivot said arms to position the spikes to enter a tire rolling over the deflator and to hold the rocker arm in position as the spike is withdrawn from the rocker arm.

7 Claims, 3 Drawing Sheets

VEHICLE TIRE DEFLATOR

BACKGROUND OF THE INVENTION

1. Field of the Invention

This invention relates to devices for use by police and the like to deflate the tires of a vehicle being operated by fleeing persons.

2. Prior Art

It is well recognized that police officials from time to time find it necessary to stop the vehicle being operated by persons who are fleeing or attempting to avoid being stopped.

Portable barricades have often been used in attempts to stop a vehicle. The blockade may be framed structures but often a portable barricade is formed with police vehicles placed to extend transversely across a roadway. It is not uncommon, however, that fugitives will attempt to drive through a blockade of saw-horse type or other framed structures or around or even through a blockade of vehicles. Naturally, there is a potentially high element of danger to police officers manning a road block and the cost is very high should a fugitive attempt to crash his vehicle through a barricade, particularly if the barricade is made of police vehicles.

Generally, also, it requires a large number of police personnel to set up and man a road blockade.

The need for a means of disabling a vehicle that can be established and manned by even a single police officer and that will effectively disable a vehicle containing one or more fleeing individuals has been recognized in the past. Thus, in U.S. Pat. No. 4,382,714, there is disclosed a vehicle disabling means in the form of a plurality of hollow, spike-like devices adapted to project perpendicular to a road surface to puncture one or more tires of a fleeing vehicle. A plurality of the devices may be interconnected to facilitate placement and to create a flailing effect within the wheel well of the vehicle.

Other tire puncturing devices, using hollow needles arranged to point vertically upwardly or upwardly at an angle and supported by metal bars or heavy canvas and/or rubber mats have also been known.

BRIEF DESCRIPTION OF THE INVENTION

The present invention is also intended to serve as a means for disabling a fleeing vehicle; that can be positioned and manned by even a single police officer; and that will effectively disable a motor vehicle.

OBJECTS OF THE INVENTION

In addition, other objects of the present invention are to provide a tire puncturing device that is compactly folded and stored; that can be immediately used without prior assembly; that can be used to disable a vehicle regardless of the direction of travel of the vehicle; and that can be made of lightweight materials such as polyurethane plastics; that will leave hollow spikes in tires passed thereover and that will leave the base support for the spikes undamaged and ready for re-use.

FEATURES OF THE INVENTION

Principal features of the invention include a base support made of articulated sections that will fold together and that will be easily extended to a length sufficient to at least reach across a roadway. Each articulated section of the base support has rocker arms mounted to pivot thereon and hollow spikes releasably carried by the rocker arms. Rocker arm actuators extend outwardly and slightly upwardly from the rocker arms at each side thereof so that a vehicle wheel rolling transversely across the rocker arm will first contact a rocker arm actuator to tilt the rocker arm and spikes carried thereby to place the spike in a tilted position to better penetrate the passing thereover. Shoulders and angled ramp surfaces insure penetration of spikes into a tire and withdrawal of the spikes from the rocker arms.

Other objects and features of the invention will become apparent from the following detailed description and drawing disclosing what are presently contemplated as being the best modes of the invention.

THE DRAWINGS

In the drawings:

FIG. 1 is a perspective view of the vehicle tire deflator of the present invention, shown folded for storage and with phantom lines representing an indefinite length of the device;

FIG. 2, a similar view but showing the vehicle tire deflator extended;

FIG. 3, a view like that of FIG. 2, with the vehicle tire deflator more fully extended;

FIG. 4, an enlarged view taken within the line 2—2 of FIG. 3;

FIG. 5, a somewhat schematic view showing a tire moving onto a portion of the vehicle tire deflector;

FIG. 6, a similar view showing the tire rolling across the deflector;

FIG. 7, another similar view showing the tire leaving the deflector; and

FIG. 8, a cross-sectional view, taken on the line 6—6 of FIG. 2.

DETAILED DESCRIPTION

Figure 1:
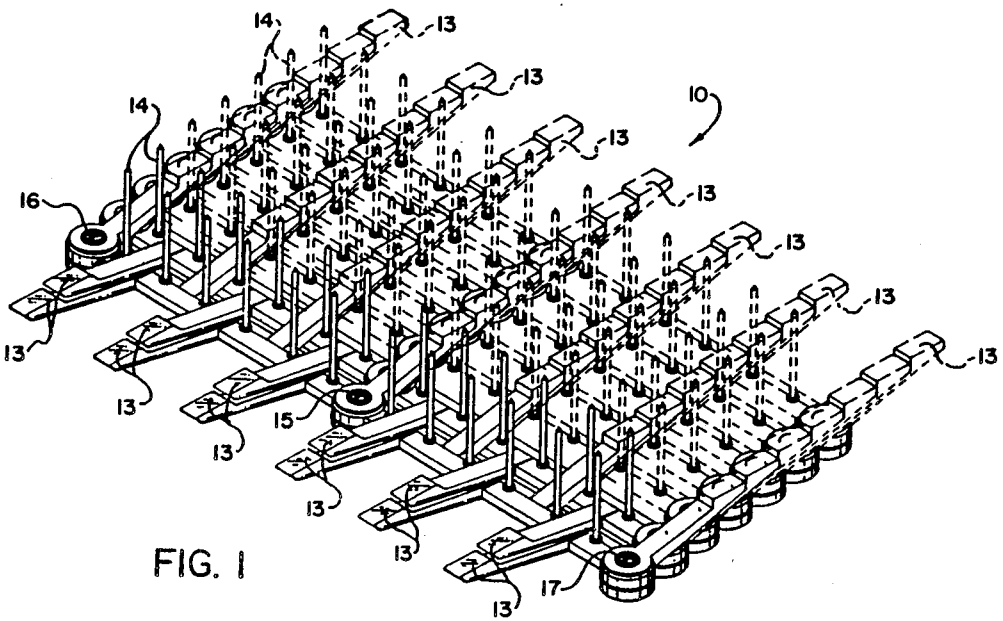

Referring now to the drawings:

In the illustrated preferred embodiment, as best shown in FIG. 1, the vehicle tire deflator shown generally at 10, includes a plurality of base supports 11, a plurality of rocker arms 12 extending across the base supports, rocker arm actuators 13 extending from opposite sides of the rocker arms 12 and a plurality of hollow spikes 14 projecting from each rocker arm.

Figure 2:
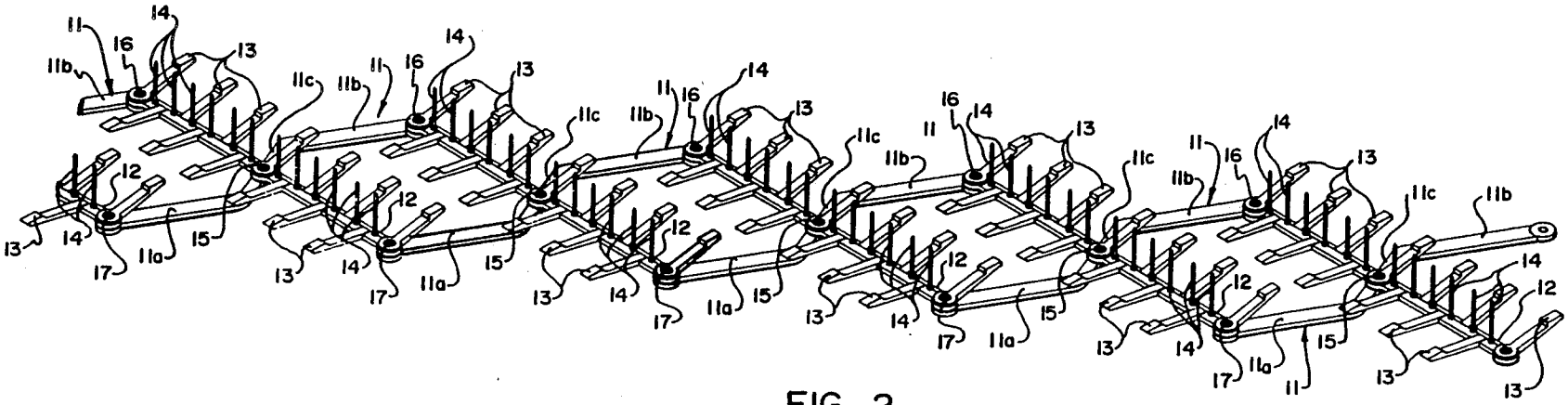
Figure 3:
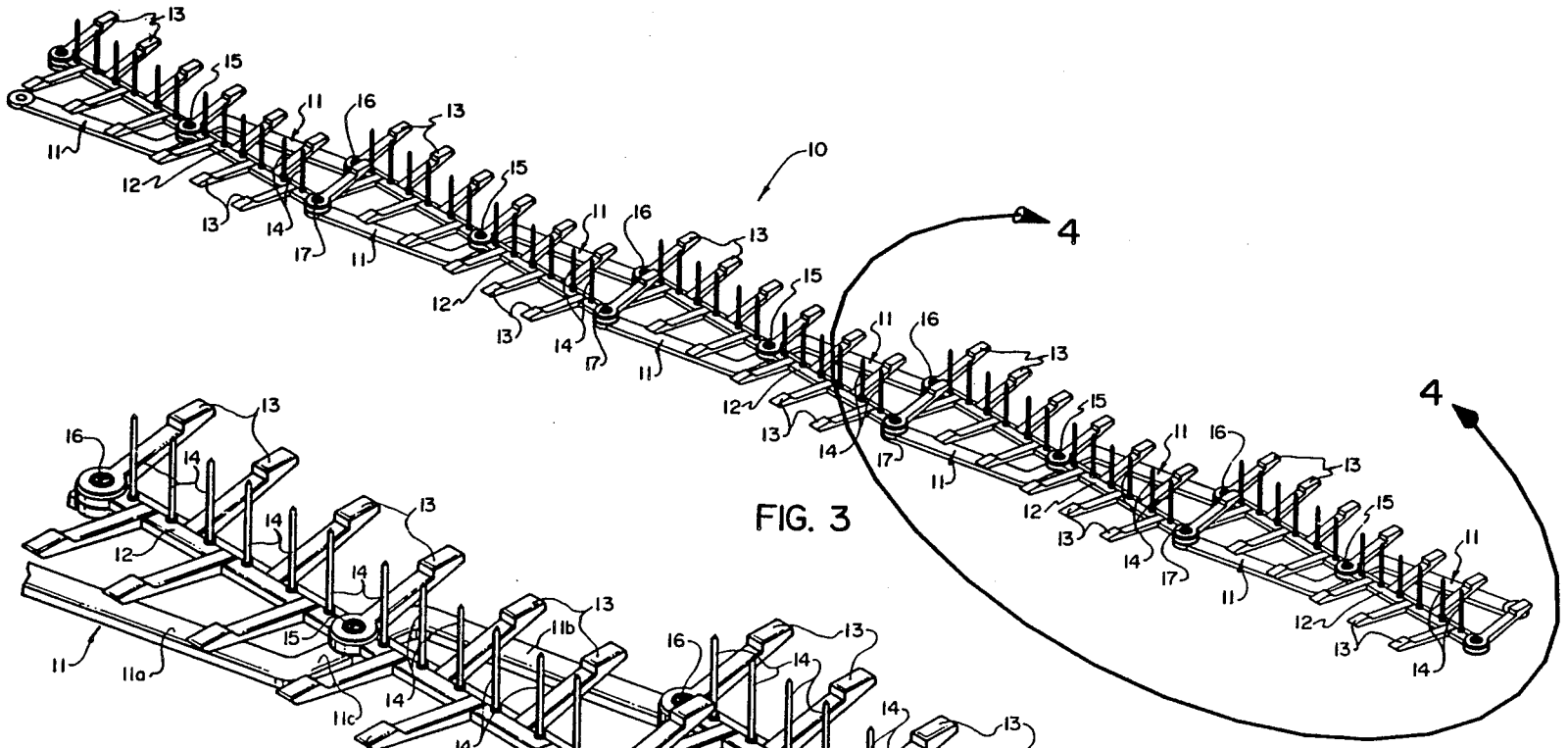
Figure 4:
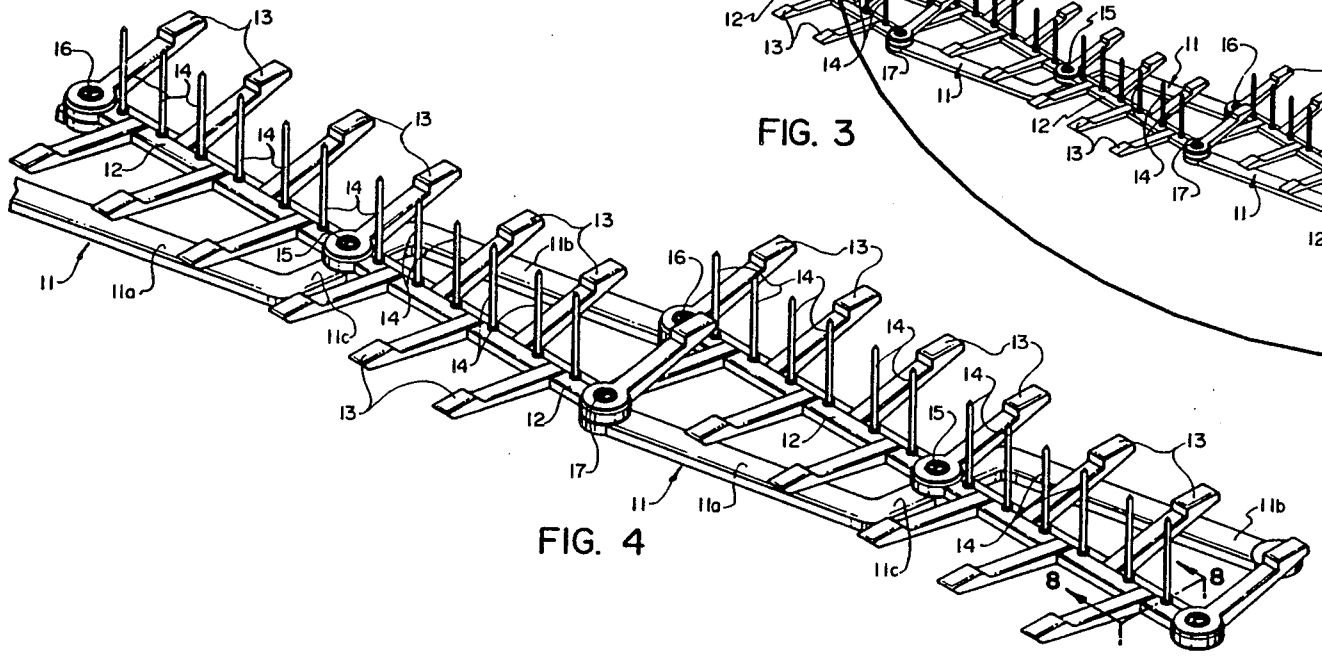

A pair of base supports 11, as shown best in FIGS. 1 through 3, of identical construction are arranged to be parallel to one another. Each base support includes a pair of legs **11*a* and 11*b* interconnected end to end by a diagonal portion 11*c*. The legs 11*a* and 11*b* and diagonal portion 11*c*** are preferably integral and formed of one piece of plastic, wood, etc.

As best seen in FIG. 2, the mid-point 15 of one support 11 is pivotally connected at 16 to the end of leg **11*b* of another support 11 by a rocker arm 12 and the end of leg 11*a* of the one support is pivotally connected at 17 to the mid-point 15 of the other support 11 by another rocker arm 12. The same pattern of connections then couples base supports 11 and rocker arms 12 so that the assembly can be of any desired length and will fold as shown in FIG. 1 or can be stretched as shown in FIG. 2**, and further to place the base supports in substantially end-to-end relationship and the spikes essentially aligned.

The pivot connections 15, 16 and 17 are loose enough that they not only permit pivoting of the base supports and rocker arms relative to one another, but they also permit the rocker arms to rock back and forth with respect to the base supports while normally holding the rocker arms in a centered position.

As previously noted, the rocker arms have rocker arm actuators 13 that extend outwardly and upwardly (when the spikes are extending upwardly) from both sides of each rocker arm and that will provide means for tilting the rocker arm in response to a vehicle tire rolling over the vehicle tire deflector 11. Shoulders 13*a* are provided on the ends of the rocker arm actuators to provide means to be gripped by the tread of a tire passing thereover and to effect a more positive pivoting of the rocker arm as the tire moves thereon.

Figure 8:
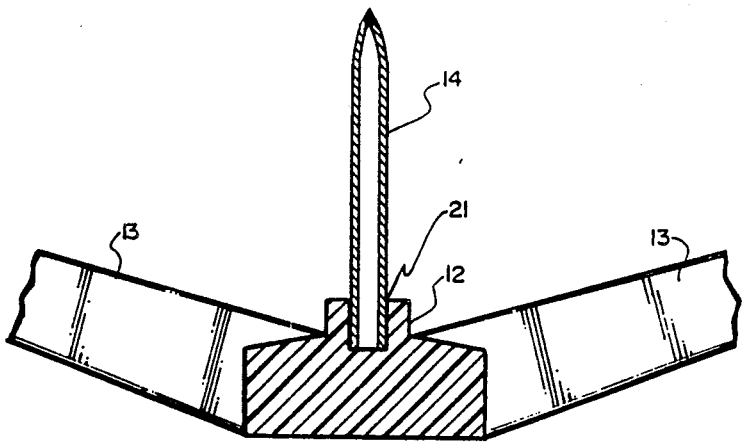

As shown best in FIG. 8, hollow spikes 14, which may be made of any desired size, and which, for example, may be hypodermic needles are inserted into sockets 21 formed in the rocker arms 12.

Figure 5:
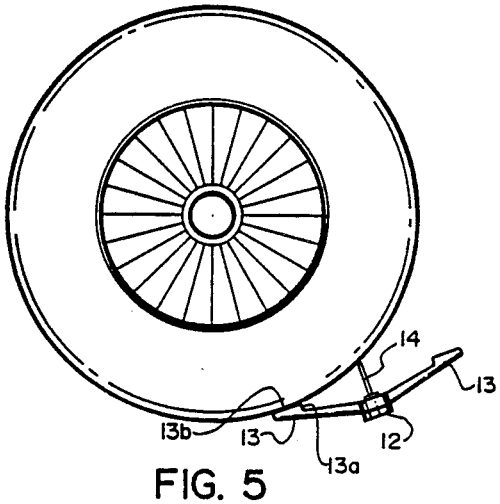
Figure 6:
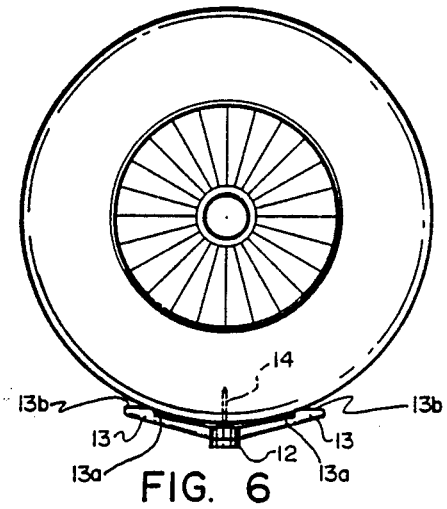
Figure 7:
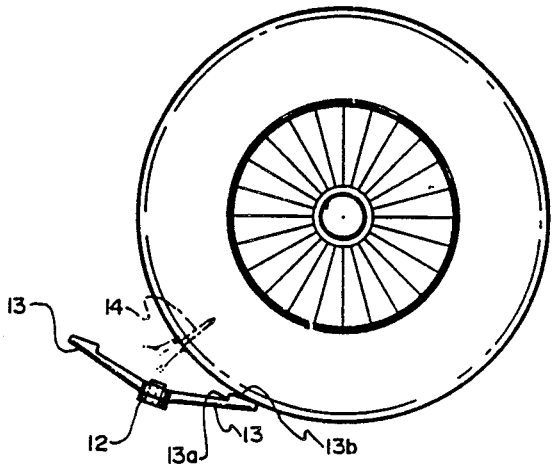

As shown best in FIGS. 5 through 7, an angled ramp surface 13*b*, extending from each shoulder 13*a* to the end of each rocker arm provides a surface that is engaged by a tire as the tire rolls off the rocker arm to hold the discharge side of the rocker arm depressed until the tires rolls fully off the rocker arm. This insures full pulling out of the hollow spike and insures passage of the wheel over the rocker arm with the spike inserted therein.

In practice, the vehicle tire deflator is folded to the compact configuration of FIG. 1 for storage and is carried in a police vehicle. When it is necessary to use the deflator to stop a traveling vehicle, the police officer simply stretches it across the path to be traveled by the vehicle to be disabled. The deflator is easily stretched out by throwing the bulk of it, while holding one end or by unfolding it as it is placed across the vehicle pathway.

The overall extended length of the vehicle tire deflator can be as desired but will normally be long enough to stretch across at least one full traffic lane. Several deflators can be placed in end-to-end stretched relationship to extend across greater distances.

Although a preferred form of our invention has been herein disclosed, it is to be understood that the present disclosure is by way of example and that variations are possible without departing from the subject matter coming within the scope of the following claims, which subject matter we regard as our invention.

We claim:

1. A vehicle tire deflator comprising, a plurality of rocker arms; means pivotally interconnecting said rocket arms to allow movement of said rocker arms to a side-by-side folded condition and an end-to-end extended condition; sockets formed in and spaced along each of said rocker arms; hollow spikes each having a base end for insertion into a said socket whereby a pointed end of each said hollow spike projects from said rocker arm; and actuator means connected to extend outwardly and upwardly from said rocker arms when said hollow spikes extend upwardly from the rocker arms, for first contacting a tire rolling thereon.

2. A vehicle tire deflector as in claim 1, wherein the means pivotally interconnecting the rocker arms comprises parallel base supports.

3. A vehicle tire deflector as in claim 2, wherein the base supports each comprise first and second offset legs interconnected by a diagonal portion, and wherein the mid-portion of one base support is pivotally connected to one end of a first leg of the other base support by a rocker arm and the end of the other end of the rocker arm is pivotally connected to the one leg of another base support.

4. A vehicle tire deflator as in claim 1, wherein the actuator means includes a ramp means extending from a shoulder formed on an end of each rocker arm to be engaged by a tire rolling onto the deflator.

5. A vehicle tire deflator as in claim 4, wherein the ramp means has a flat surface and is formed on opposite ends of each rocker arm and is inclined upwardly from each shoulder on each end of said rocker arm where the ramp means flat surface is engaged by a tire rolling onto or off of the deflator.

6. A vehicle tire deflator as in claim 3, wherein the actuator means includes a ramp means extending from a shoulder formed on an end of each rocker arm to be engaged by a tire rolling onto the deflator.

7. A vehicle tire deflator as in claim 6, wherein the ramp means has a flat surface and is formed on opposite ends of each rocker arm and is inclined upwardly from each shoulder on each end of said rocker arm whereby the ramp means flat surface is engaged by a tire rolling onto or off of the deflator.

* * * * *